US010850293B2

(12) United States Patent
Lim

(10) Patent No.: US 10,850,293 B2
(45) Date of Patent: Dec. 1, 2020

(54) DEVICE FOR SPRAYING LIQUID COSMETIC MIST

(71) Applicant: Jong Su Lim, Pocheon-si (KR)

(72) Inventor: Jong Su Lim, Pocheon-si (KR)

( * ) Notice: Subject to any disclaimer, the term of this patent is extended or adjusted under 35 U.S.C. 154(b) by 0 days.

(21) Appl. No.: 16/527,805

(22) Filed: Jul. 31, 2019

(65) Prior Publication Data

US 2020/0078808 A1 Mar. 12, 2020

(30) Foreign Application Priority Data

Sep. 6, 2018 (KR) ..... 10-2018-0106371

(51) Int. Cl.
*B05B 11/00* (2006.01)
*A45D 34/00* (2006.01)
*B65D 83/00* (2006.01)

(52) U.S. Cl.
CPC ..... *B05B 11/3025* (2013.01); *A45D 34/00* (2013.01); *B65D 83/0005* (2013.01); *A45D 2034/002* (2013.01); *A45D 2200/056* (2013.01)

(58) Field of Classification Search
CPC . B05B 11/3025; B05B 11/3023; A45D 34/00; A45D 2034/002; A45D 2200/056; A45D 2200/055; B65D 83/0005
USPC ..... 222/321.2
See application file for complete search history.

(56) References Cited

U.S. PATENT DOCUMENTS 4,361,255 A * 11/1982 Saito ..... B05B 11/304 222/321.2
4,462,549 A * 7/1984 Saito ..... B05B 11/3016 222/321.2
4,530,449 A * 7/1985 Nozawa ..... B05B 11/3063 222/189.11
4,856,677 A * 8/1989 Brunet ..... B05B 11/3015 222/94
5,358,149 A * 10/1994 O'Neill ..... B05B 11/3016 222/321.2
5,560,520 A * 10/1996 Grogen ..... B05B 11/3016 222/321.2
5,626,264 A * 5/1997 Florez ..... B05B 11/3018 222/321.2
5,664,706 A * 9/1997 Cater ..... B05B 11/3018 222/321.2
5,692,649 A * 12/1997 Schwab ..... B05B 11/0097 222/321.3
2011/0084100 A1* 4/2011 Welp ..... B05B 11/0075 239/463

(Continued)

FOREIGN PATENT DOCUMENTS

KR 10-0434190 B1 9/2004
KR 10-0485039 B1 4/2005

(Continued)

*Primary Examiner* — Benjamin R Shaw
(74) *Attorney, Agent, or Firm* — Novick, Kim & Lee, PLLC; Jae Youn Kim

(57) ABSTRACT

Provided is a device for spraying liquid cosmetic mist, the device including: a body, a cylinder, a valve member, a first piston, and a second piston. Accordingly, it is possible to prevent liquid leakage in the process of guiding atomization spraying of liquid cosmetics while excluding the addition of external air based on a hand-operated simple configuration with a light weight and a slim structure, thereby improving quality and convenience.

4 Claims, 5 Drawing Sheets

(56) References Cited

U.S. PATENT DOCUMENTS

| | | | | |
|---|---|---|---|---|
| 2012/0325862 | A1* | 12/2012 | Kuwahara | B05B 11/3053 222/321.9 |
| 2019/0344297 | A1* | 11/2019 | Barenhoff | B05B 11/3023 |

FOREIGN PATENT DOCUMENTS

| | | | |
|---|---|---|---|
| KR | 10-2012-0059893 | A | 6/2012 |
| KR | 10-1826634 | B1 | 2/2018 |

* cited by examiner

DEVICE FOR SPRAYING LIQUID COSMETIC MIST

BACKGROUND OF THE INVENTION

1. Field of the Invention

The present invention relates to a device for spraying liquid cosmetic mist, and more particularly, to a device for spraying liquid cosmetic mist, in which cosmetics having low viscosity is accommodated in a hand-operated container so that a user can use the cosmetics while carrying the hand-operated container.

2. Description of the Related Art

In general, a cosmetic container for spraying mist while storing and keeping cosmetics in a liquid or gel state is formed in a structure that allows the contents to be smoothly discharged to the outside by using a pumping device installed inside the cosmetic container. In the cosmetics field, the mist market has focused on the supply of water in the early stage, and it is gradually expanding to add fragrance. In consideration of the above tendency, it becomes more important to have a simple design with a light weight and a slim structure in which a motor is excluded such that the pumping can be manually performed by a user.

As related documents incorporated herein as reference, there are Korean Patent Registration No. 0485039 (Related Document 1) and Korean Patent Registration No. 1826634 (Related Document 2).

According to related document 1, a cylindrical guide tube protrudes in a compression chamber of a pump, a pair of protrusions are formed to protrude inward in an operation chamber, and a sealing ring, which is externally inclined and has a pressing space and an inclined surface, is formed along a lower outer surface of a second valve. Therefore, the airtightness function is improved so that the malfunction due to the leakage of pressure in the compression chamber can be prevented, and the spraying efficiency can be improved due to the strong instantaneous pressure.

However, although the metered spraying can be induced while keeping the airtightness by the connection of a piston ring of a piston and the sealing ring of the second valve, inflow of external air is not large enough to maintain the fine mist state.

Related document 2 includes a compression chamber formed between a cap housing and a piston housing; a piston for discharging compressed air and contents while moving up and down; an opening/closing portion for discharging the contents and the compressed air or introducing external air according to the operation of the piston; and an atomizing portion for atomizing the compressed air and the contents in the form of a whirlwind at an upper end of the piston. Therefore, it is expected that there is no increase in size caused by air compression and safety is improved.

However, related document 1 is advantageous for atomization of mist due to the generation of compressed air when compared with related document 1, but there is a disadvantage that a minute amount of contents may leak through a path of the external air.

RELATED DOCUMENTS

Patent Document (Patent Document 1) Korean Patent Registration No. 0485039 entitled "Spray Pump of Cosmetic Container" (Published on May 22, 2003)

(Patent Document 2) Korean Patent Registration No. 1826634 entitled "Mist pump of cosmetic container" (Published on Feb. 8, 2018)

SUMMARY OF THE INVENTION

In order to solve the problems occurring in the related art, an object of the present invention is to provide a device for spraying liquid cosmetic mist, capable of preventing liquid leakage in the process of guiding atomization spraying of liquid cosmetics while excluding the addition of external air based on a hand-operated simple configuration with a light weight and a slim structure.

In order to achieve the above object, the present invention provides a device for spraying liquid cosmetic mist, the device including: a body having a boss portion; a cylinder which is in close contact with a lower end of the boss portion in the body and accommodates a stem and a spring therein; a valve member coupled to the boss portion of the body to move up and down and having an opening/closing hole between upper and lower spaces thereof; a first piston coupled to an upper portion of the stem to move up and down and having a flow hole in a flow groove; and a second piston concentrically coupled to the first piston at a lower end thereof and closely making contact with the valve member at an upper end thereof.

In detail, the first piston may be provided at a lower end thereof with an elastic portion having a gradient to come into close-contact with an inner surface of the cylinder.

In detail, the second piston may have a corrugated portion protruding annularly from an inner surface of the second piston that comes into contact with the first piston.

In detail, the second piston may be provided at an upper end thereof with a blade piece protruding in an annular shape having a curved groove and provided at a lower end thereof with an elastic portion having a gradient to come into close-contact with an inner surface of the cylinder.

In detail, the first piston and the second piston may be engaged with each other through stepped portions formed in elastic portions of the first and second pistons.

As described above, according to the present invention, it is possible to prevent liquid leakage in the process of guiding atomization spraying of liquid cosmetics, which is caused by the compression and addition of external air, based on a hand-operated simple configuration with a light weight and a slim structure, thereby improving quality and convenience.

DETAILED DESCRIPTION OF THE INVENTION

Figure 1:
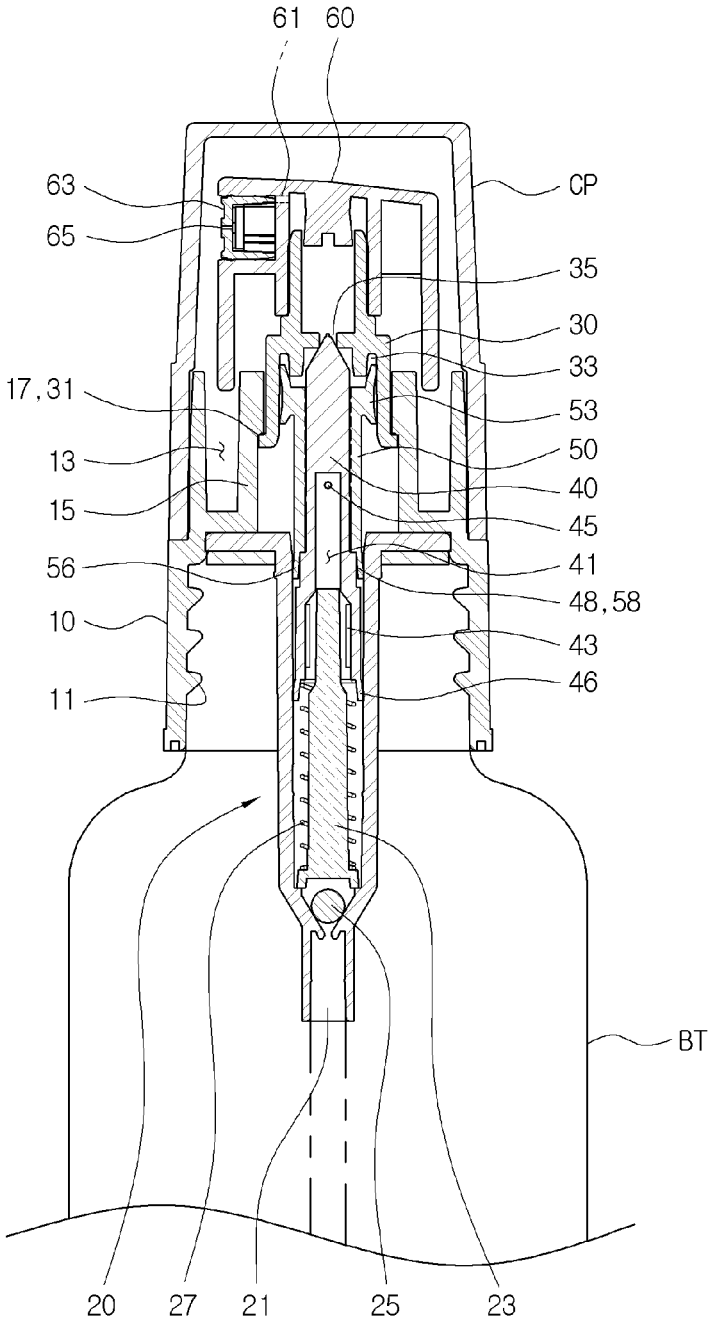
FIG. 1 is a view showing an overall configuration of a spraying device according to the present invention.

Hereinafter, embodiments of the present invention will be described in detail with reference to the accompanying drawings.

The present invention proposes a device for spraying liquid cosmetic mist. The present invention relates to a device for spraying a liquid cosmetic (cosmetic liquid) having a low viscosity contained in a hand-operated container in a mist state, but is not necessarily limited thereto.

A body 10 according to the present invention may be configured to have a boss portion 15. The body 10 may be a portion that is coupled with a cosmetic container to support main components to be described below. The body 10 may be integrally formed at an upper side thereof with the boss portion 15 and at a lower side thereof with a coupling portion 11. The coupling portion 11 may be coupled to an upper end of the cosmetic container through a screw-coupling scheme or the like. The boss portion 15 may include an annular guide groove 13 which may be formed concentrically with the boss portion 15. The guide groove 13 may be a portion that accommodates a lower end of a push button 60 to be described be such that the bush button 60 may move up and down.

Referring to FIG. 1, the cosmetic container is denoted by BT and a cap coupled to an upper end of the body 10 is denoted by CP. In the description of the present invention, terms indicating the directions of up, down, left and right will be defined based on FIG. 1.

Meanwhile, the push button 60 may move up and down by the pressure of the user's finger to spray mist through a spray hole 65 formed in an atomizing unit 63. The structure and function of the atomizing unit 63 are disclosed in related document 2 filed by applicant of the present invention.

In addition, according to the present invention, a cylinder 20, in which a stem 23 and a spring 27 are received, may be configured to closely adhere to a lower end of the boss portion 15 in the body 10. Referring to FIG. 1, the cylinder 20 is illustrated like an outer body of a syringe. An upper end of the cylinder 20 may be coupled to the boss portion 15 through the coupling portion 11 of the body 10. The stem 23 may have a smaller diameter at an upper side thereof and a larger diameter at a lower side thereof. A sphere 25 may be received in the cylinder 20 at a lower side of the stem 23. The sphere 25 may be mounted so as to open and close an inflow hole 21 formed at a lower end of the cylinder 20. The spring 27, which is concentrically mounted around an outer peripheral surface of the stem 23, may come into contact with the first piston 40 to exert an elastic force, which will be described below.

Further, according to the present invention, a valve member 30 having an opening/closing hole 35 between upper and lower spaces thereof may be coupled to the boss portion 15 of the body 10 to move up and down. Referring to FIG. 1, the valve member 30 may be integrally formed with an upper space having a smaller diameter and a lower space having a larger diameter. The opening/closing hole 35, through which the cosmetic liquid flows, may be formed between the upper and lower spaces of the valve member 30. A lower portion of the valve member 30 may be supported by the boss portion 15 of the body 10 in such a manner that the valve member 30 may move up and down concentrically with the boss portion 15. A protrusion 17 of the boss portion 15 may engage with a protrusion 31 of the valve member 30 to limit the upstroke of the valve member 30.

Figure 2A:
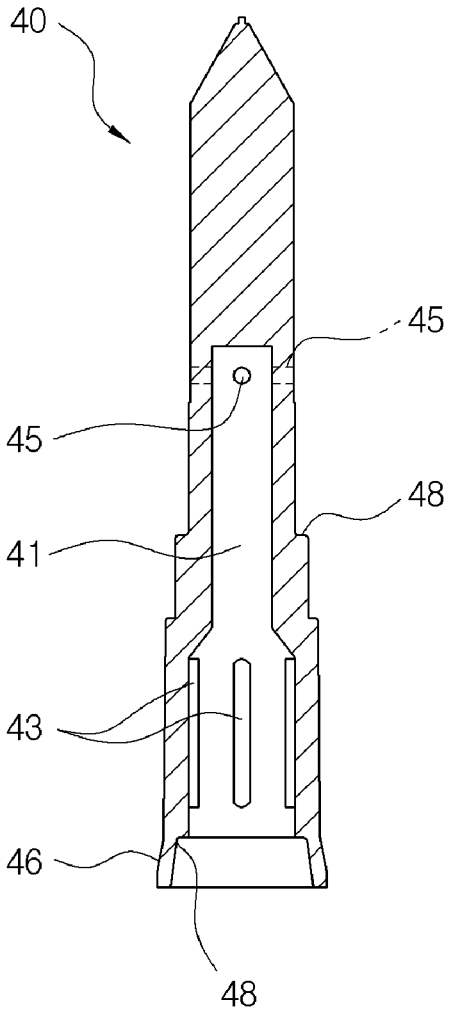
FIGS. 2(*a*) and 2(*b*) are views showing main parts of the spraying device according to the present invention.
Figure 2B:
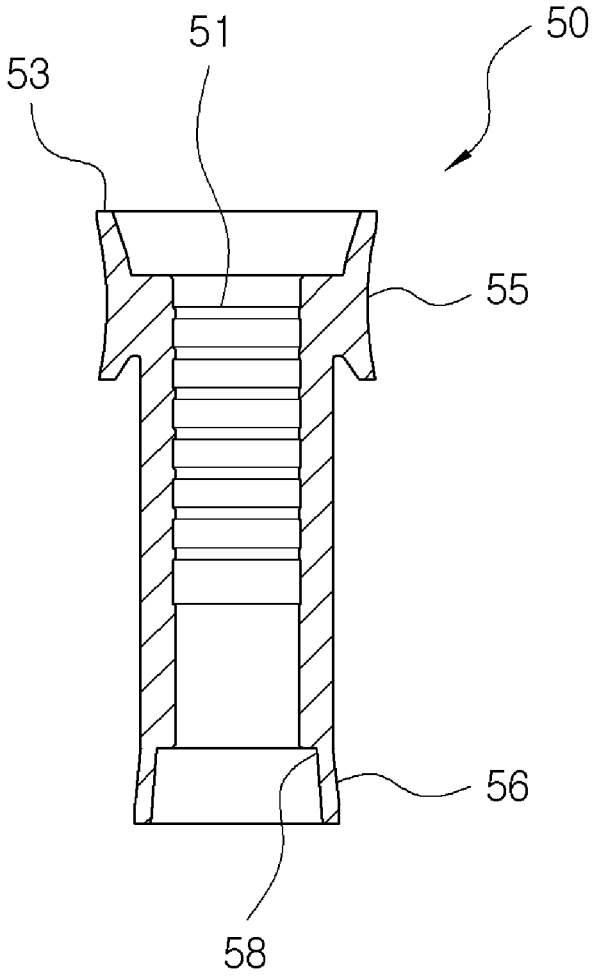

In addition, according to the present invention, the first piston 40 having the flow hole 45 in a flow groove 41 may be coupled to an upper portion of the stem 23 to move up and down. As shown in FIGS. 1, 2(*a*) and 2(*b*), the first piston 40 may include an upper portion having a smaller diameter and a lower portion having a larger diameter. The flow groove 41, which is formed upward from a lower end of the first piston 40, may engage with the upper portion of the stem 23 to perform the pumping motion for the cosmetic liquid. A plurality of flow holes 45 communicating with an outer peripheral surface of the flow groove 41 may be formed in an upper region of the flow groove 41. A plurality of guide ribs 43 making contact with the stem 23 may be formed axially in a lower region of the flow groove 41.

In detail, the first piston 40 of the present invention may be provided at a lower end thereof with an elastic portion 46 having a gradient to come into close-contact with an inner surface of the cylinder 20. A lower end of the elastic portion 46 of the first piston 40 may be expanded with a gradient, which may be formed through a flare processing. The elastic portion 46 of the first piston 40 may come into contact with the inner surface of the cylinder 20 at a predetermined pressure. Accordingly, the vacuum pressure may be maintained while the pumping motion is being performed by the up/down movement of the first piston 40, so that the cosmetic liquid in the container BT may be smoothly guided in the upward direction.

Meanwhile, although it is not shown in the drawings, the elastic portion 46 may be formed of a material different from that of other regions, or a metal may be inserted into the elastic portion 46 through an insert molding process to enhance the elastic force.

In addition, according to the present invention, a lower end of the second piston 50 may be concentrically connected to the first piston 40 to interwork with the first piston 40 and an upper end of the second piston 50 may closely adhere to the valve member 30. As shown in FIGS. 1, 2(*a*) and 2(*b*), the second piston 50 may have a substantially cylindrical shape which is thicker and shorter than the first piston 40. The second piston 50, which may be concentrically coupled to the first piston 40, may be tightly received in the lower space of the valve member 30 while facing the boss portion 15 of the body 10. Accordingly, the valve member 30, the second piston 50, and the first piston 40, which may be arranged downward of the push button 60, may simultaneously perform the up/down movement corresponding to the stem 23.

In detail, the second piston 50 of the present invention may include a corrugated portion 51 protruding in an annular shape from an inner surface of the second piston 50 which may come into contact with the first piston 40. A cylindrical gap defined by the inner surface of the second piston 50 and an outer surface of the first piston 40 may serve as a passage through which the cosmetic liquid moves upward and the cosmetic liquid may be prevented from being flowing back or leaked due to the corrugated portion 51. The corrugated portion 51 may have a structure in which annular rims protruding at a small height may be formed at regular intervals.

In detail, the second piston 50 of the present invention may be provided at an upper end thereof with a blade piece 53 protruding in an annular shape having a curved groove 55 and provided at a lower end thereof with an elastic portion 56 having a gradient to come into close-contact with the inner surface of the cylinder 20. The blade piece 53 may be formed at an upper portion of the second piston 50 and engage with a guide groove 33 of the valve member 30. The curved groove 55 formed in the blade piece 53 may enhance the contact pressure at upper and lower ends of the blade piece 53 by the elastic force with respect to the valve member 30 to block the leakage of the cosmetic liquid. Similarly to the elastic portion 46 described above, the elastic portion 56 of the second piston 50 may also be expanded with a gradient and may come into contact with the inner surface of the cylinder 20 at a predetermined pressure. Accordingly, the expansion pressure may be maintained while the pumping motion is being performed by the up/down movement of the first piston 40, thereby inducing the smooth spraying of the cosmetic liquid in the container BT.

In detail, the first piston 40 and the second piston 50 of the present invention may be engaged with each other through stepped portions 48 and 58 formed in the elastic portions 46 and 56, respectively. The stepped portion 48 formed at the lower end of the first piston 40 may tightly engage with the spring 27 to increase the elastic force of the elastic portion 46. The stepped portion 48 formed at the upper end of the first piston 40 may engage with the stepped portion 58 of the second piston 50 to increase the elastic force of the stepped portion 58. In this way, the elastic portions 46 and 56 may maintain the airtightness with respect to the inner surface of the cylinder 20.

Meanwhile, the push button 60 may have a flow hole 61 on a path ranging from the upper space of the opening/closing hole 35 to the atomizing unit 63.

Figure 3:
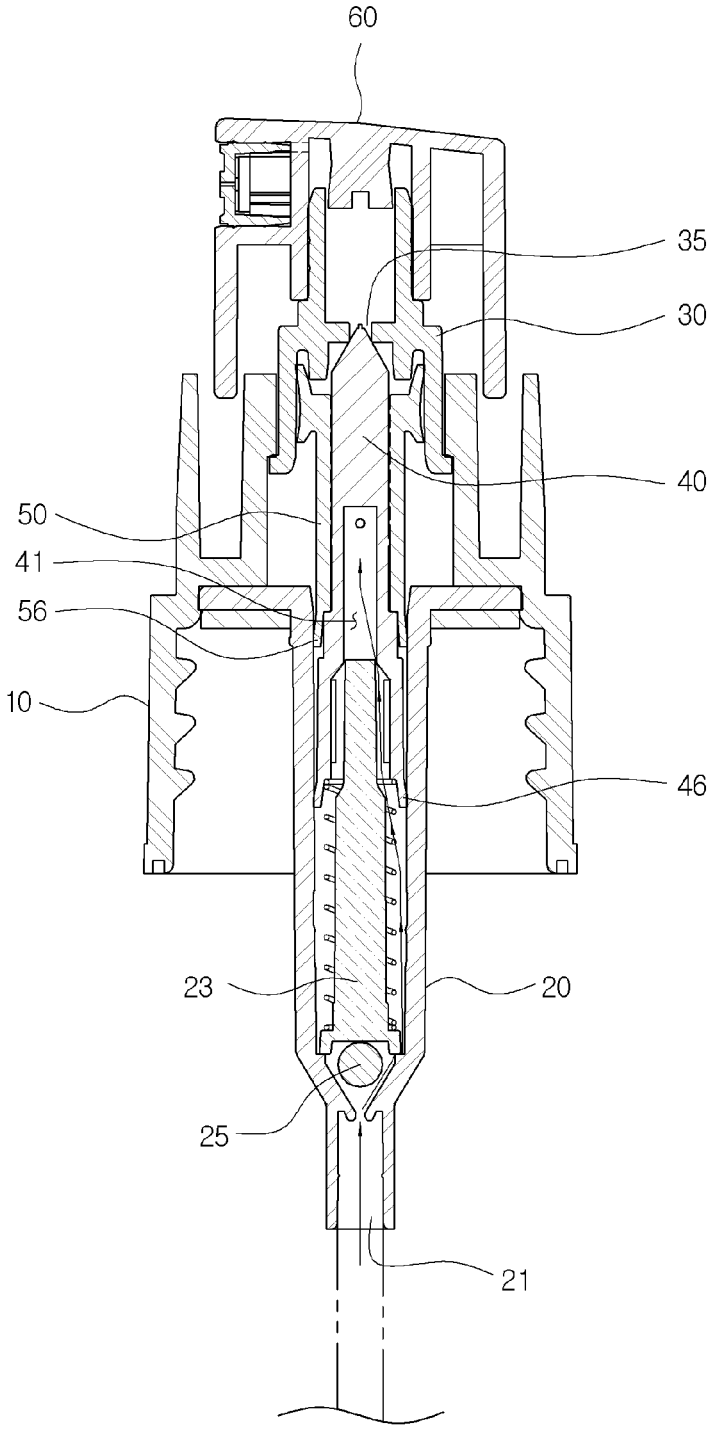
FIG. 3 is a schematic sectional view showing a state before the spraying device according to the present invention is operated.
Figure 4:
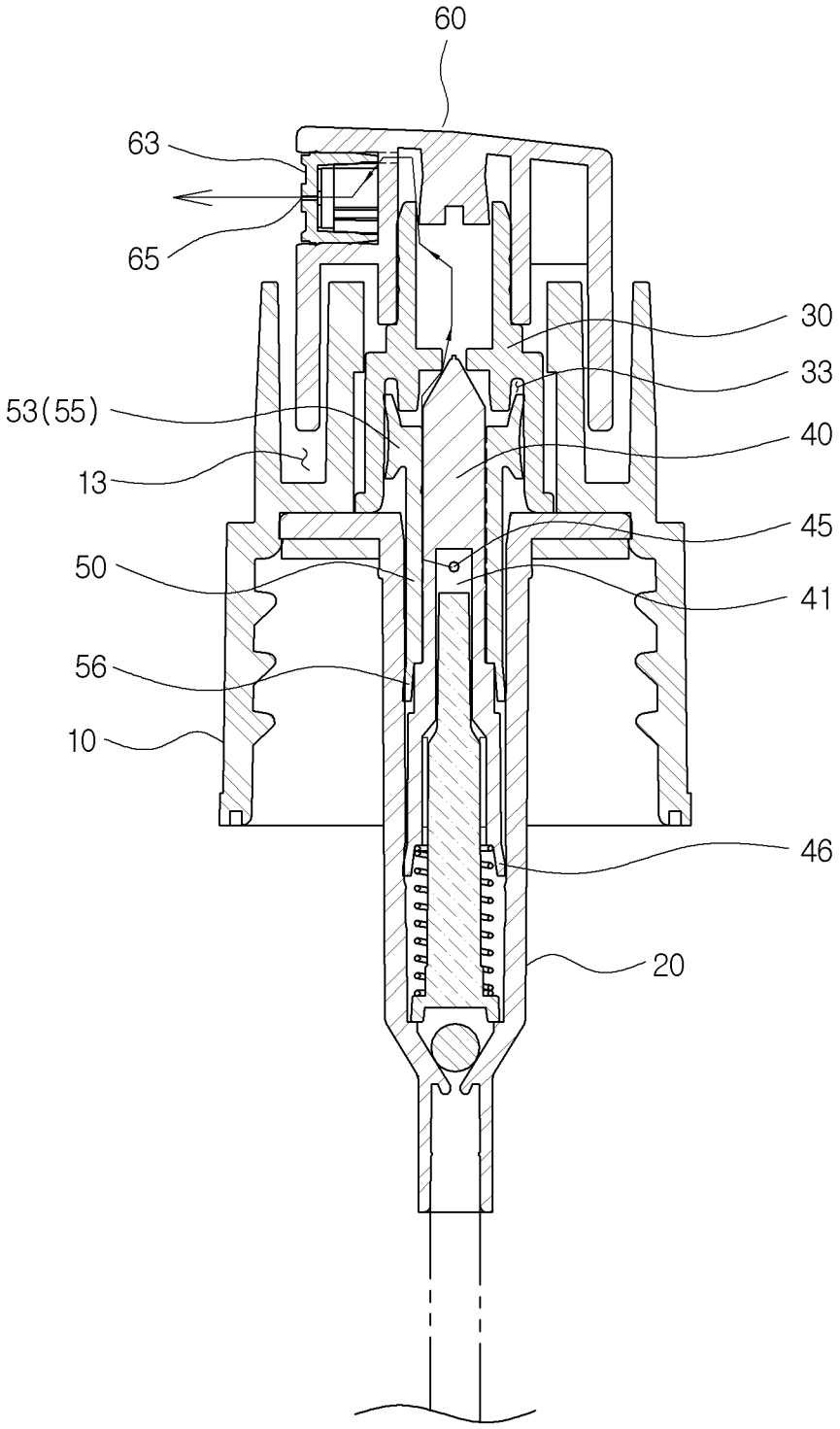
FIG. 4 is a schematic sectional view showing a state after the spraying device according to the present invention is operated.

Hereinafter, one example of the operation will be described with reference to FIGS. 3 and 4. In general, a user couples the device of the present invention to the container BT, opens the cap CP and presses the push button 60 to spray the mist. As shown in FIG. 3, while the pressed push button 60 is returning to the upstroke end by the spring 27, the cosmetic liquid may reach the flow groove 41 by way of the sphere 25, the periphery of the stem 23, and the lower end of the first piston 40. In this process, the elastic portion 46 of the first piston 40 may maintain the vacuum pressure, so that the ascending and suction of the cosmetic liquid may be smoothly performed. When the push button 60 moves down as shown in FIG. 4, the cosmetic liquid in the flow groove 41 may be sprayed through the spray hole 65 by way of the flow hole 45, the corrugated portion 51 of the second piston 50, the opening/closing hole 35, the flow hole 61, and the atomizing unit 63. In this process, the pressure of the flow groove 41 may be increased, but the elastic portion 56 may maintain the expansion pressure so that the cosmetic liquid may be smoothly sprayed.

It will be apparent to those skilled in the art that various modifications and variations can be made in the present invention without departing from the spirit and scope of the invention. It is therefore intended that such variations and modifications fall within the scope of the appended claims.

What is claimed is:

1. A device for spraying liquid cosmetic mist, the device comprising:

a body having a boss portion;

a cylinder which is in close contact with a lower end of the boss portion in the body and accommodates a stem and a spring therein;

a valve member coupled to the boss portion of the body to move up and down and having an opening/closing hole between upper and lower spaces thereof;

a first piston coupled to an upper portion of the stem to move up and down and having a flow hole in a flow groove; and a second piston concentrically coupled to the first piston at a lower end thereof and closely making contact with the valve member at an upper end thereof, wherein the second piston has a corrugated portion protruding in an annular shape from an inner surface of the second piston that comes into contact with the first piston.

2. The device of claim 1, wherein the first piston is provided at a lower end thereof with an elastic portion having a gradient to come into close-contact with an inner surface of the cylinder.

3. The device of claim 1, wherein the second piston is provided at an upper end thereof with a blade piece protruding in an annular shape having a curved groove and provided at a lower end thereof with an elastic portion having a gradient to come into close-contact with an inner surface of the cylinder.

4. The device of claim 1, wherein the first piston and the second piston are engaged with each other through stepped portions formed in elastic portions of the first and second pistons.

* * * * *